United States Patent [19]

Westwinkel

[11] Patent Number: 5,056,877

[45] Date of Patent: Oct. 15, 1991

[54] LOCKING ANTI-TIP DEVICE

[75] Inventor: Florian Westwinkel, Mississauga, Canada

[73] Assignee: Pundra Industries Limited, Toronto, Canada

[21] Appl. No.: 520,797

[22] Filed: May 8, 1990

[51] Int. Cl.[5] ..... E05C 7/06

[52] U.S. Cl. ..... 312/221; 312/217

[58] Field of Search ..... 312/216, 217, 218, 219, 312/220, 221, 222

[56] References Cited

U.S. PATENT DOCUMENTS 4,429,930 2/1984 Brown ..... 312/222

4,768,844 9/1988 Ludwig ..... 312/221

4,889,396 12/1989 Mitchell ..... 312/221

4,936,640 6/1990 Pratler ..... 312/221

*Primary Examiner*—Kenneth J. Dorner

*Assistant Examiner*—Gerald A. Anderson

*Attorney, Agent, or Firm*—Blake, Cassels & Graydon

[57] ABSTRACT

A batching mechanism for an anti-tipping drawer mechanism rigidly attaches adjacent stacked drawers in the retracted position, thus mitigating the tendency to looseness in the mechanism. Preliminary withdrawal movement of any one drawer detaches the latching means and thereafter, further movement of the drawer actuates anti-tipping latching of the other drawers.

13 Claims, 7 Drawing Sheets

44a
180
180
200
150
192
142
174
146
172
140
141
170
182

LOCKING ANTI-TIP DEVICE

BACKGROUND OF THE INVENTION

1. Field of the Invention

This invention relates to latching mechanisms for stacked drawer arrangements, for example, in filing cabinet, which mechanisms act to allow withdrawal of only one drawer at a time. Such arrangements are intended to maintain the stability of the stack against tipping.

2. Background of the Invention

The provision of anti-tip latching arrangements has presented a large number of practical problems and a large amount of prior art exists. Generally, anti-tip mechanisms require great precision in installation of the anti-tip interactive components secured, for example, to a filing cabinet, and of the related actuating pins carried by the cabinet drawers.

There are at least two basic arrangements conventionally used. In the first of these arrangements, each drawer is associated with a single vertical bar of similar height to the height of the respective drawer. Each bar is itself associated with a stop to prevent withdrawal of its associated drawer. The bars and their stops are positionable such that all the stops except one are located to block withdrawal of their respective drawers.

In the second conventional arrangement, each drawer is associated with a pair of vertical bars (split bars), each pair being associated with a stop for the respective drawer. The system works in a somewhat similar manner to that described for the first system, but this second system may be more versatile in that each stop may be located at the junction between bars of each pair and the length of each bar of the pair may be selected at will.

When using the second, split bar system, it may be possible to locate stops on or about the level of the drawer track. In fact, U.S. patent application No. 384,792 to Pratzer and assigned to the same assignee as the present invention, discloses and claims a system which is mountable on a drawer track rather than on the filing cabinet wall or other wall as was previously thought necessary. This may allow for some degree of lesser accuracy in installation.

Other patents representative of the art are U.S. Pat. No. 4,768,844 issued Sept. 6th, 1988 to Ludwig and U.S. Pat. No. 4,429,930 issued February 1984 to Blouin.

While the prior art is replete with examples of anti-tipping mechanisms some general problems remain. Among these are the fact that it is necessary to provide both an upper and a lower stop for the vertical bars to limit the total spacing in which it is possible to adjust them. Moreover, in existing systems the positions of the upper and lower stops must be accurate so that the resultant spacing between them is accurate. Thus, if the total space available for adjustment is too large it may be possible to withdraw more than one drawer at a time. Sequential or concurrent withdrawal of two drawers may also be possible in some cases due to "sponginess" between adjacent bars, which are supposedly located in the non-withdrawal positions.

SUMMARY OF THE INVENTION

According to the present invention, there is provided a drawer interlock system for stacked drawers which operates by inter-related movements of stacked members associated with the drawers between locking and releasing positions. In which latching means rigidly, vertically attaches adjacent members to one another in the retracted position of all the drawers and in which preliminary withdrawal movement of any one single drawer from the stack actuates the latching means to detach a respective single pair of members.

The mechanism may comprise a plurality of stacked bars associated with the drawers and movable axially between locking and releasing positions. A drawer latch cam for each drawer is adapted to be engaged with the respective drawer in a closed position and adapted to be disengaged from the drawer in an open position. The drawer latch cam is pivotally mounted on a one of a pair of adjacent upper and lower bars for pivotal movement between the open and closed positions. A bar latch is associated with each drawer latch cam and is fixed in position with respect to a respective cam for movement therewith. The bar latch securely attaches, in the closed position of the respective cam, the other of the pair of upper and lower bars in stacked, end-to-end, adjacent relationship with said one bar, and, in the open position of the respective cam, releases said other bar. Translating means is provided responsive to pivotal opening movement of the drawer latch cam, to translate said pivotal movement into axial movement between the said pair of upper and lower bars to move said one bar between its releasing position and to locking position together with any bars stacked.

The drawer latch cam may conveniently be carried fixedly by a shaft which is pivotable in an aperture through said one bar. The bar latch may comprise hook adapted to engage said other bar which hook is either integral with the drawer latch cam is carried fixedly on the same shaft as the drawer latch cam to pivot with it.

The said one bar may suitably be a lower bar. In this case, the shaft carrying the drawer latch cam and the bar latch may extend pivotably through a bearing through the upper end of the bar and the bar latch may extend upwardly to engage the upper bar. Suitably, the projection from the upper bar may be a shaft extending through the upper bar from a cam follower adapted to move vertically in following a cam surface of the drawer latch cam as it pivots between its open and closed positions.

Each drawer latch cam may have a fork adapted to engage a pin projecting from a respective drawer to actuate movement of the cam on each of withdrawal or retraction of the respective drawer.

BRIEF DESCRIPTION OF THE DRAWINGS

Embodiments of the invention will now be described by way of example with reference to the drawings, in which.

DESCRIPTION OF PREFERRED EMBODIMENTS

Figure 1:
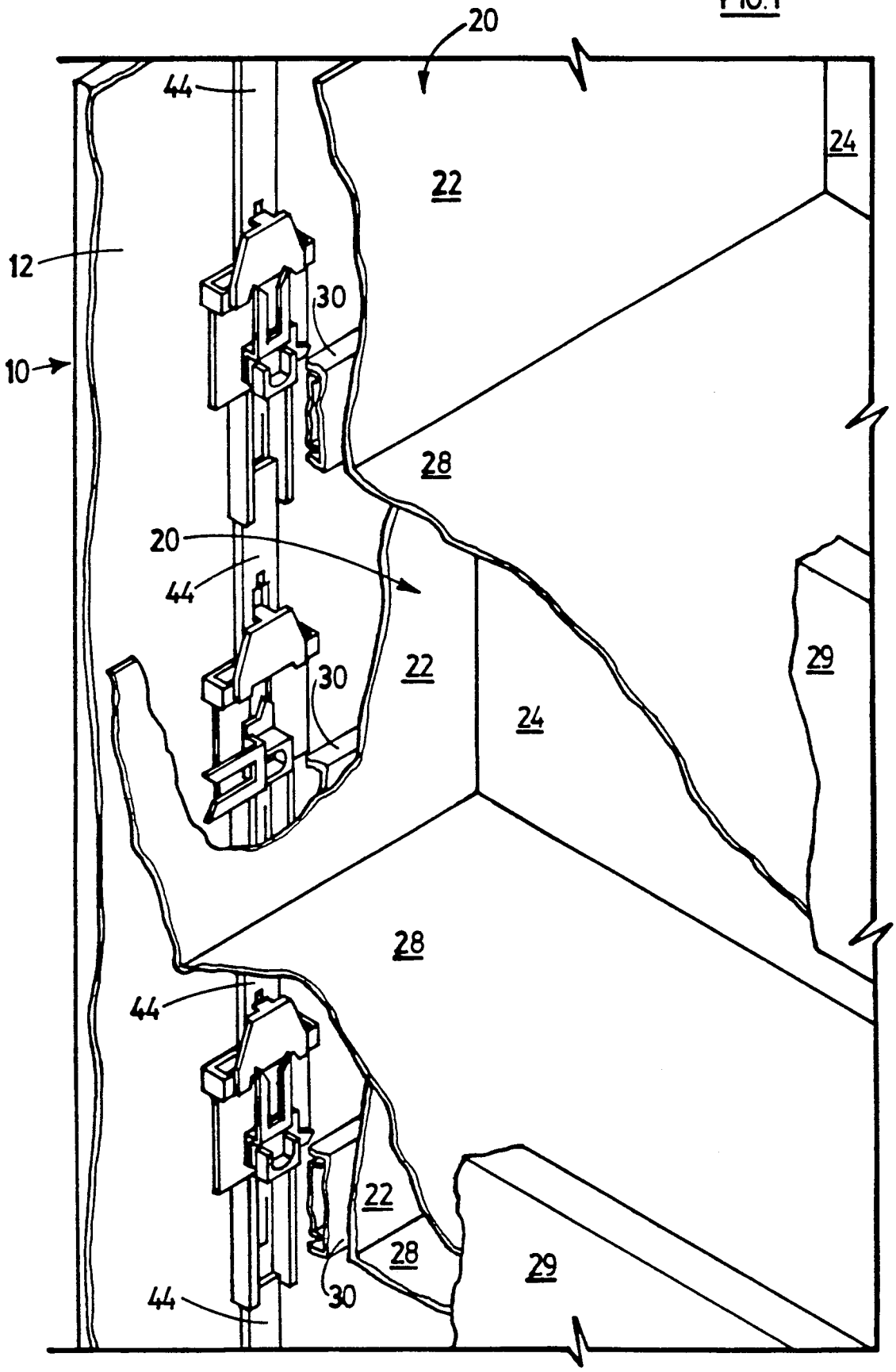
FIG. 1 shows a number of stacked drawers, the drawing being partially broken away to show an embodiment of the invention.

Referring now to FIG. 1, it will be seen that the cabinet according to the invention is shown generally as 10 having a side wall 12.

Typically, filing cabinets come with a Plurality of drawers in a variety of numbers, depending upon the requirements of the user. Such drawers are shown generally as 20, and will be seen to comprise side panels 22, a back panel 24, a bottom panel 28 and a front panel 29. Typically, in the case of file drawers, for example, such drawers are mounted on telescopic extendable slides indicated as 30.

In order to avoid tipping of the cabinet on opening more than one heavy drawer at a time, drawer interlocks are provided such that when one drawer has been opened, the remaining drawers are locked shut. This then forces persons to close a drawer, before any others can be opened.

In some cases, it is possible to combine such a drawer interlock system with a key lock system for actually locking the filing drawers as a security measure when the office is unoccupied.

It will of course be appreciated that the drawer interlock system according to the invention can be provided with such a key lock system if desired, in a manner well known in the art, the details of which are omitted for the sake of clarity. Such drawer interlock systems are common utilizing stacked vertical bars 44 movable vertically between drawer locking and drawer releasing positions. However, such systems may not guard against simultaneous withdrawal of drawers and there may be too much play or sponginess between adjacent bars.

Figure 2:
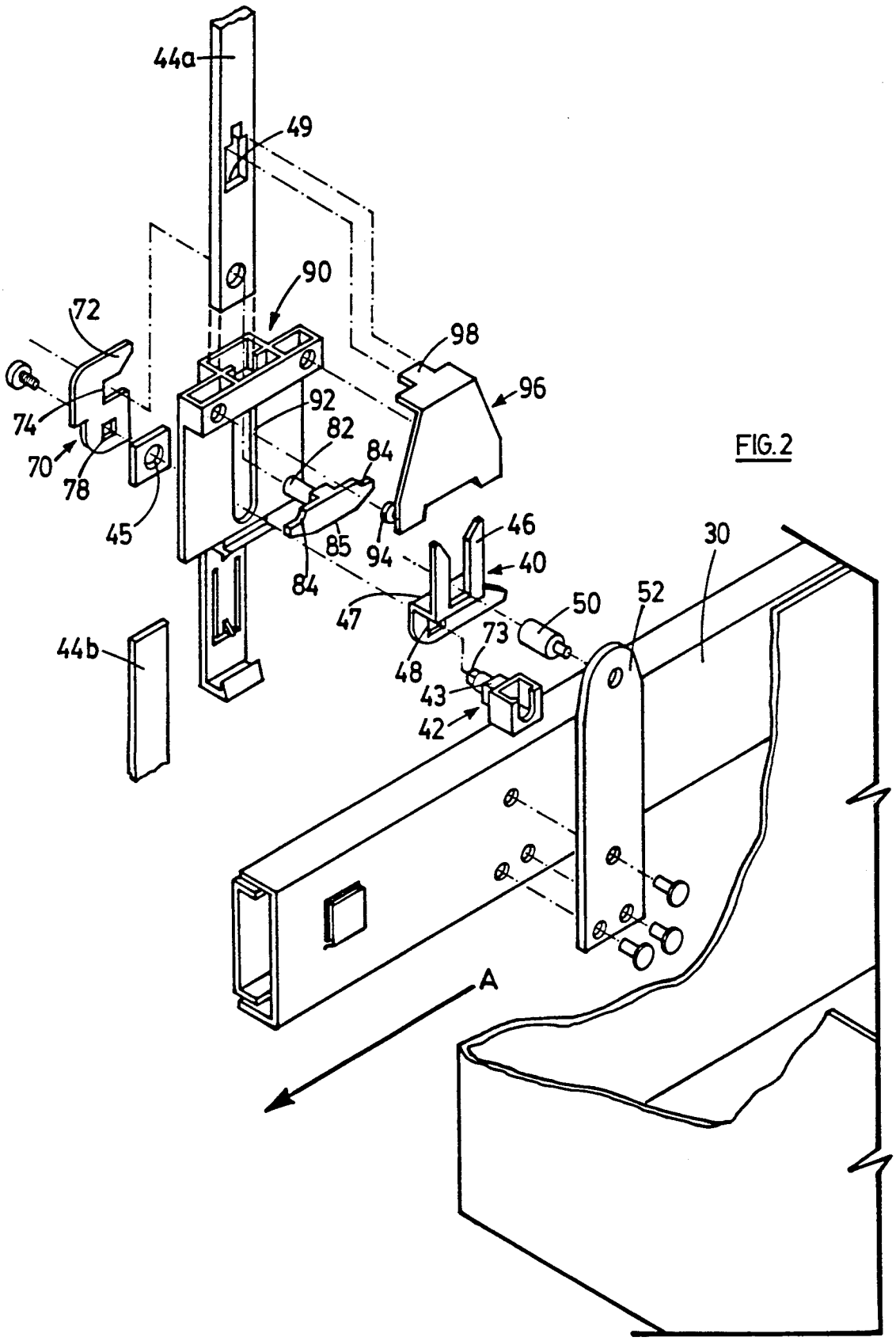
FIG. 2 is an exploded view of the mechanism of FIG. 1 in the drawer closed condition.
Figure 3:
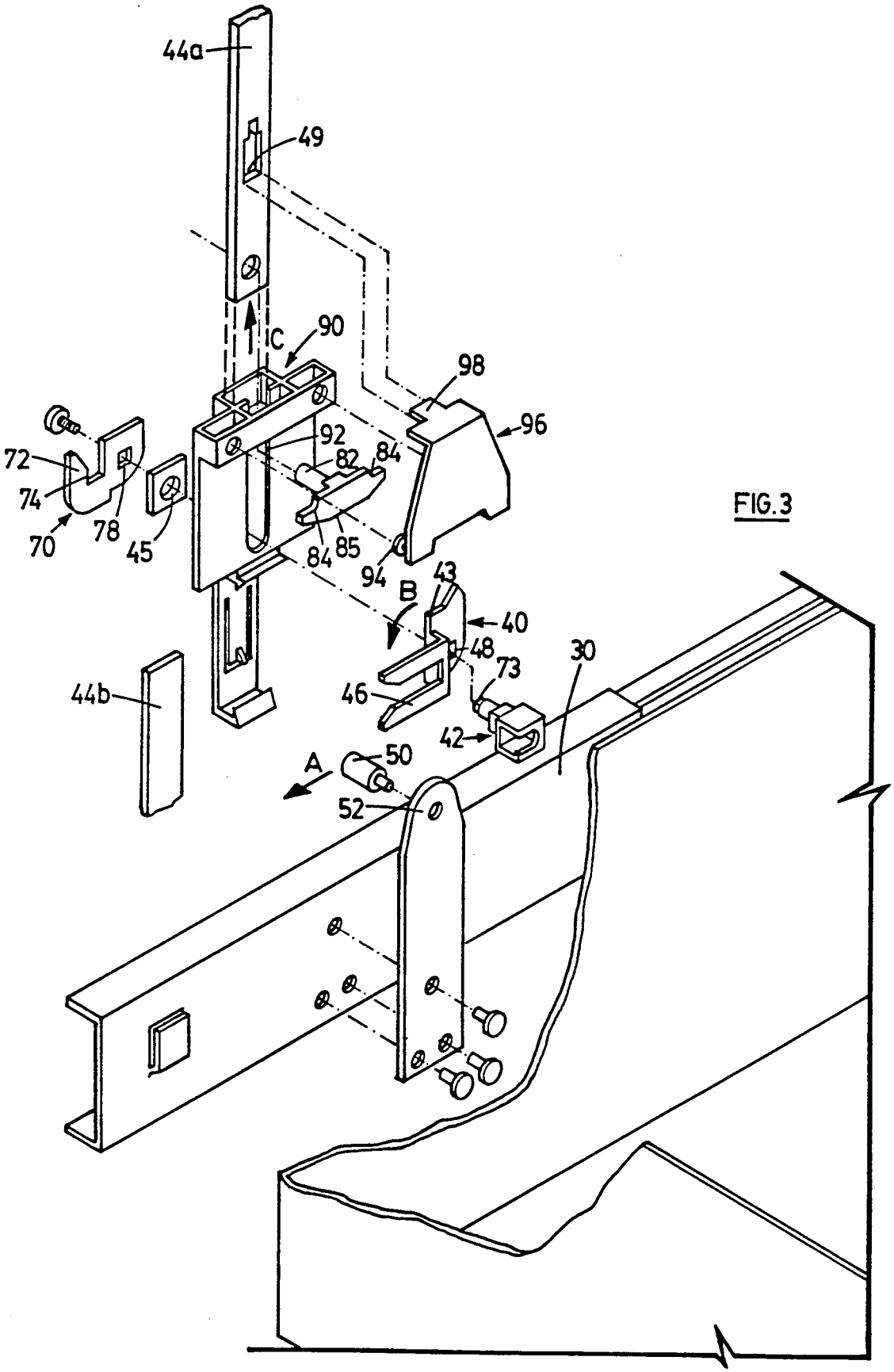
FIG. 3 is a similar exploded view to that of FIG. 2 but in the drawer open condition.
Figure 4:
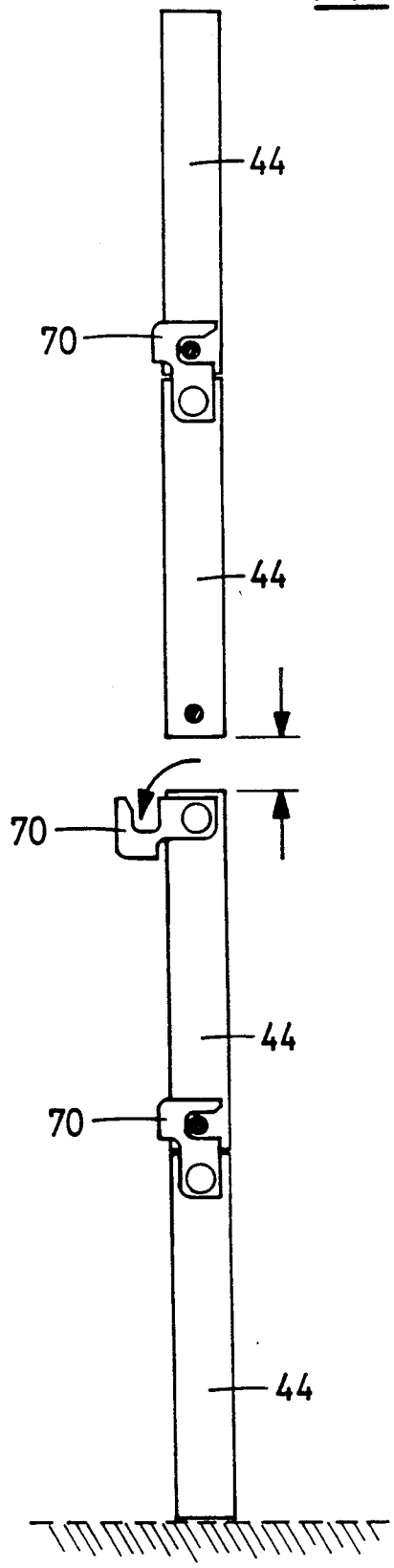
FIG. 4 is a diagrammatic representation of the mechanism of FIGS. 1 to 3.

The drawer interlock system according to the invention is shown in more detail in FIGS. 2 and 3. It will be seen to comprise a plurality of drawer interlock cams, each of which is shown as 40, and which may be provided either one cam to each drawer, or two such cams, one on either side of each drawer if desired for greater security. In this case it will of course be appreciated that the mechanism which is shown in FIGS. 2 and 3 would be provided on the right and left hand side walls of the cabinet 10. For the purposes of this discussion, however, only one such mechanism will be described, it being understood that the description would be equally applicable to the interlock mechanism on the other end of the cabinet, if such was provided.

The cam 40 is fixedly mounted on a pivot shaft for example, through a part 43 of the shaft of square section to prevent rotation of the cam 40 or shaft 42. The shaft 42 pivots in a bearing 45 through a lower slide bar 44*b* of a pair of slide bars 44*a* and 44*b*. Pivot shaft 42 passes through square hold 48 in cam 40 and may be mounted to a drawer slide 30. Alternatively the mounting may be to the cabinet sidewall 12.

A bar latch 70 is also fixedly mounted on pivot shaft 42 through a square hole 78 and a square section end 73 of the pivot shaft 42. The bar latch 70 comprises a hook portion 72 forming a recess 74 to engage a projection 82 from upper slide bar 44*a*. Projection 82 is conveniently a pin pivoting in a bearing 84 in upper slide bar 44*a* and connected to a cam follower 80 of cam surface 47 is formed as a step between limbs of the cam 40 one of which limbs comprises fork 46 and the other of which includes the pivot axis of drawer latch cam 40.

The drawer latch cam 40 comprises a fork 46 to engage a pin 50 of any drawer 20 in such a manner that withdrawal of drawer 20 in the direction of the arrows A shown in FIGS. 2 and 3, and corresponding movement of pin 50 in fork 46 will act to rotate cam 40 and shaft 42 with bar latch 70 from the position shown in FIG. 2 to that shown in FIG. 3. Pin 50 is suitably connected to drawer 20 through a mounting plate 52.

When a person attempts to open any drawer 20 when all the drawers 20 are in their retracted locations, pin 50 will start to move in the direction of arrow A (FIGS. 1 and 2). If rotation of cam 40 is blocked (as will be later described), fork 46 will, with pin 50 act as a latch against drawer opening. If rotation of cam 40 is not blocked, then pin 50 will act to rotate cam 40 and shaft 42 in the direction of arrow B (FIG. 3) through 90° into the position shown in FIG. 3. Bar latch 70 will also rotate so that hook 72 engaging pin 82 will rotate so that recess 74 is vertical and open to the top to allow upward movement of pin 82.

Cam surface 47 tilts through the diagonal to the vertical with rotation of cam 40 tending to turn cam follower 80 eccentrically with it. Pin 82 of cam follower 80 is however constrained for vertical movement only in guide slot 92 of guide 90 for slide bars 44. Thus, instead of turning with cam surface 47, the cam follower 80 slides up the diagonal surface presented to it by cam surface 47 and pin 82 rises out of recess 74 forcing upper slide bar 44*a* to rise also in the direction of arrow C (FIG. 3).

When the Pin 50 has turned the cam 40 and hence the fork 46 through 90°, then the cam follower 80 is in its highest position. In this position, guide surface 84 abuts against stop pins 94 of a static guide 96. Guide 96 has a prong 98 on which a vertical slot 49 of upper slide bar 44*a* slides. Prong 98 together with slot 49 acts as a further guide to keep bar 44*a* vertical and, as a stop to prevent further upward movement of bar 44*a*. Guide surfaces 84 of cam follower 80 bear or pins 94 on the one hand, and cam follower surface 85 bears against rotated cam 40 at bearing edge 43 to fix the distance of separation between upper bar 44*a* and lower bar 44*b*. Since upper bar 44*a* may not rise further lower bar 44*b* is fixedly (while respective drawer 29 is open) separated from it the positions of these two bars are fixed.

Thus, when a drawer 20 is open it is not possible to open lower drawers. In order to open such lower drawers it is necessary to raise the respective slide bar 44*a* by the mechanism described. Since the slide bars are stacked and due to the already open drawer, a pair of members of the stack are fixed, upward adjustment of the lower members is no longer possible. Downward adjustment may be blocked by a fixed base.

If upward adjustment of slide bars 44 above those associated with the already open drawer is also inhibited, then opening of upper drawers will also be stopped. Various means are conventional for achieving this, for example, the provision of an upper stop above the stacked bars of the provision of further members 96 having prongs 98 or other means. Generally, the provision of such means is conventional but problems have remained in providing such means incorporating rigidity and lack of sponginess in the connection between two abutting stacked bars.

Figure 5:
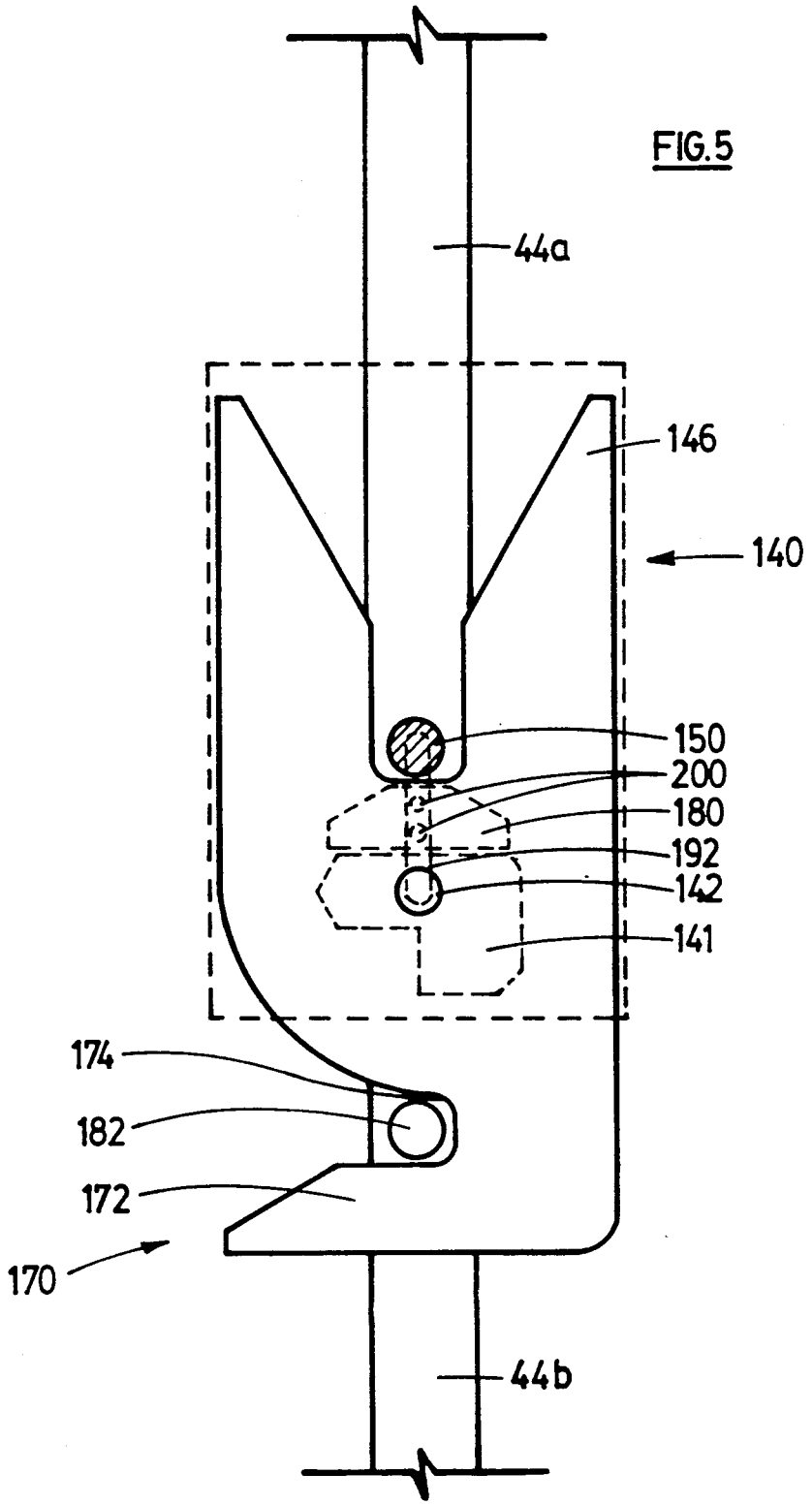
FIG. 5 shows a simplified diagram of another embodiment of the invention in the drawer closed condition.
Figure 6:
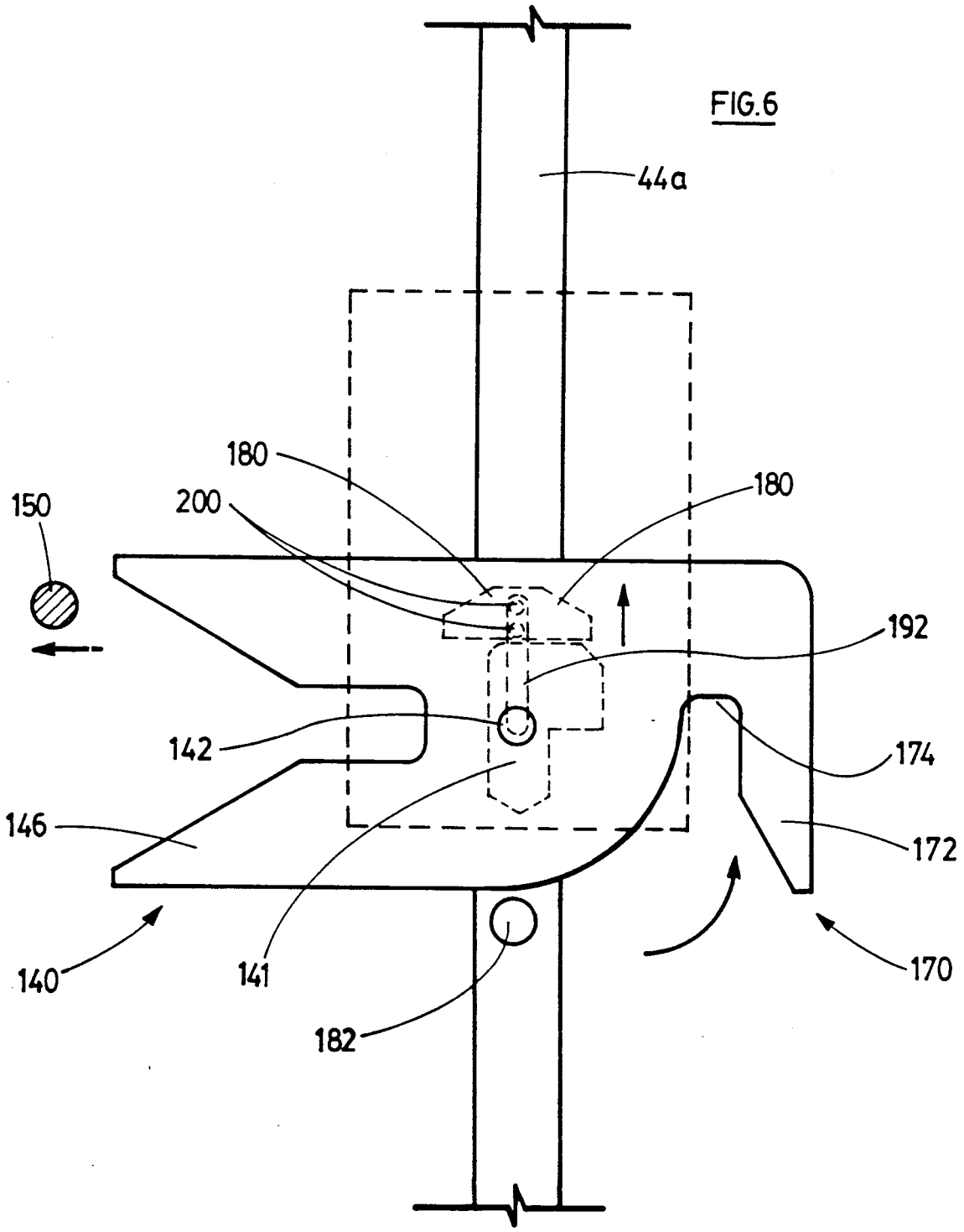
FIG. 6 shows the embodiment of FIG. 5 in the drawer open condition.
Figure 7:
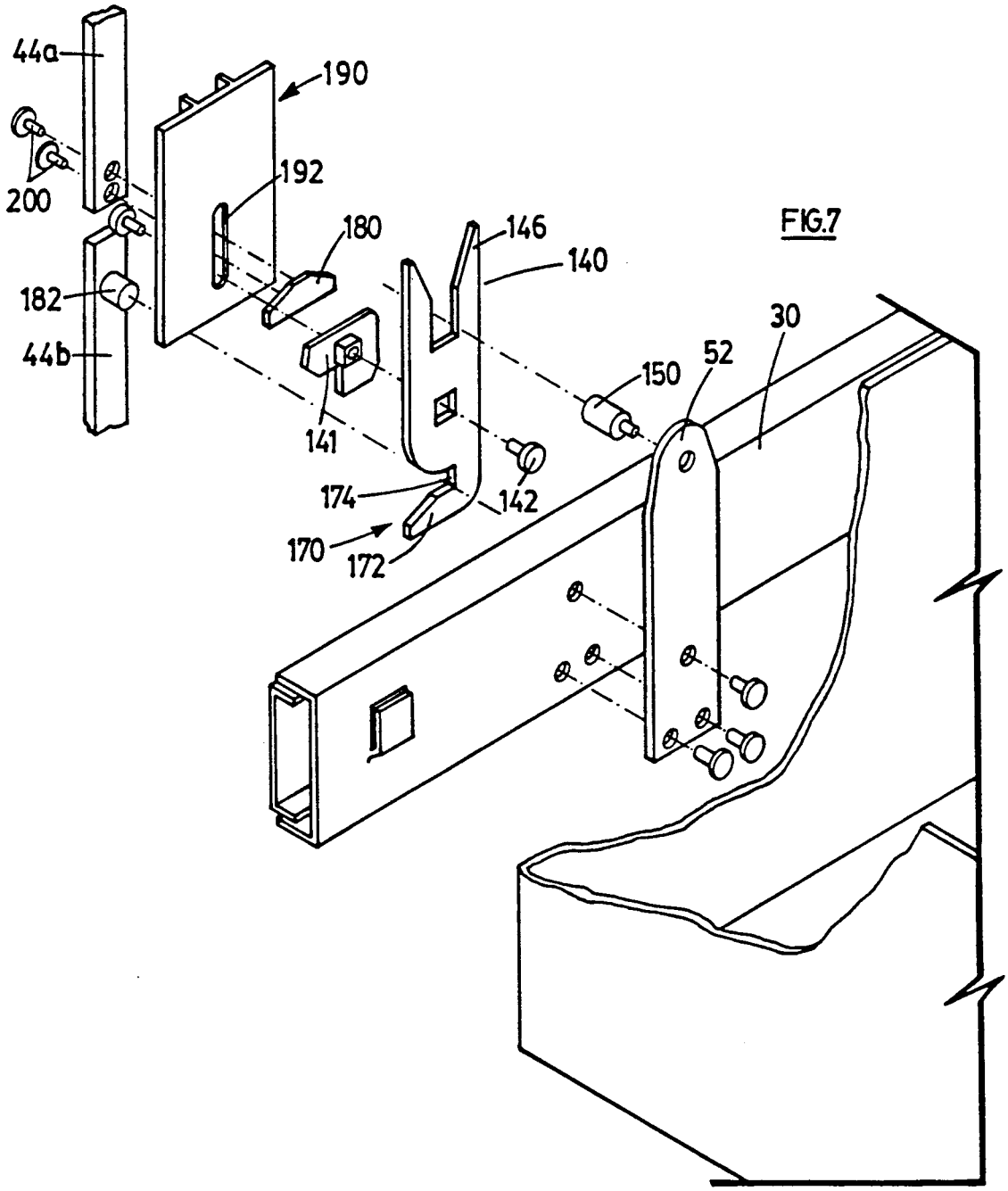
FIG. 7 is an exploded view of the embodiment of FIGS. 5 and 6 in the drawer closed condition.

FIGS. 5, 6 and 7 illustrate another embodiment of a slightly simpler construction. A fork 146 associated with a cam 140 is engagable with a drawer pin 150 and is integral with a bar latch 170.

In this case, the bar latch 170, the drawer latch cam 140 and fork 146 are pivotable on a lower slide bar 44*b* on a pivot pin 142.

Withdrawal of the drawer in the direction of arrow D, fork 146 pivots anti-clockwise so that an L-shaped cam 141 of the drawer latch 140 pivots to bear against cam follower 180 fixed directly to the base of upper slide bar 44*a* through at least one pin 200 extending through a vertical guide slot 192.

Bar latch hook 172 with is associated recess 174 engage pin 182 directly attached to the lower slide bar 44*b*. The operation of this embodiment is generally similar to that of the first embodiment, the open position of the drawer being shown in FIG. 6.

FIG. 7 shows a exploded view to better illustrate the parts shown in diagrammatically in FIGS. 5 and 6.

We claim:

1. A drawer interlock system for a stack of vertically stacked drawers, comprising a plurality of stacked bars associated with the drawers and movable axially between locking and releasing positions;

a drawer latch cam for each drawer adapted to be engaged with the respective drawer in a closed position and adapted to be disengaged from the drawer in an open position, the latch cam being pivotally mounted on one of a pair of adjacent upper and lower bars for pivotal movement between the open and closed positions;

a bar latch associated with each latch drawer cam and fixed in position with respect to a respective cam for movement therewith, the bar latch securely attaching, in the closed position of the respective cam, the other of the pair of adjacent upper and lower bars in stacked, end-to-end, adjacent relationship with said one bar, and, in the open position of the respective cam, releasing said other bar;

translating means responsive to pivotal opening movement of the drawer latch cam to translate said pivotal movement into axial relative movement between the upper and lower bars to move said one bar between its releasing position and its locking position together with any bars stacked above it.

2. A drawer interlock system as claimed in claim 1, in which the drawer cam is carried fixedly by the shaft which is pivotable in an aperture through said one bar, and the bar latch comprises a hook adapted to engage said other bar, which hook is integral with the drawer latch cam.

3. A drawer interlock system as claimed in claim 1, in which the drawer cam is carried fixedly by the shaft which is pivotable in an aperture through said one bar, and the bar latch comprises a hook adapted to engage said other bar, which hook is carried fixedly on the same shaft as the drawer latch cam, whereby the drawer latch cam and the hook are pivotable together.

4. A drawer interlock system as claimed in claim 3, in said one bar is a lower bar, and in which the shaft carrying the drawer latch cam and the bar latch extends pivotably in a bearing through the upper end of the lower bar, the bar latch extending upwardly to engage the upper bar.

5. A drawer interlock system as claimed in claim 4, in which the bar latch engages the upper bar through a hook of the bar latch and a projection from the upper bar.

6. A drawer interlock system as claimed in claim 5, in which the projection from the upper bar is an upper shaft extending in a bearing through the upper bar, the upper shafts also carrying a cam follower for the drawer latch cam, constraining means being provided to constrain the cam follower to move vertically on pivotal movement of the drawer latch cam.

7. A drawer interlock system as claimed in claim 6, in which drawer latch cam has a fork adapted to engage a pin projecting form a respective drawer to actuate movement of the cam on each of withdrawal or retraction of the respective drawer.

8. A drawer interlock system as claimed din claim 6, in which the constraining means comprises a pin on the cam follower slidable in a vertical guide slot.

9. A drawer interlock system as claimed in claim 7, in which the drawer latch cam has a lower limb attached to said shaft, an upper limb comprising the fork, the upper and lower limbs being stepped through a cam surface for actuating movement between the respective upper and lower bars, the cam surface being orthogonal to the upper and lower limbs.

10. A drawer interlock system as claimed in claim 2, in which the drawer latch cam comprises a first limb comprising a fork adapted to engage a pin projecting from a respective drawer to actuate movement of the cam on each withdrawal or retraction of the drawer, and a second limb comprising a hook adapted to engage said other bar, in the closed position of the cam, and to release said other bar in the open position of the cam.

11. A drawer interlock system as claimed in claim 10, in which said first and second limbs are diametrically arranged with respect to a pivot axis of the cam.

12. A drawer interlock system as claimed in claim 11, in which a cam surface is provided for the drawer latch cam to interact directly with a cam follower on the other of said bars.

13. A drawer interlock system as claimed in claim 12, in which the drawer latch cam is pivoted on the lower bar and the cam follower is on the upper bar.

* * * * *